US006637416B2

(12) United States Patent
Wakahara

(10) Patent No.: US 6,637,416 B2
(45) Date of Patent: Oct. 28, 2003

(54) DIAGNOSIS APPARATUS FOR DETECTING ABNORMAL STATE OF EVAPORATION GAS PURGE SYSTEM

(75) Inventor: Keiji Wakahara, Inazawa (JP)

(73) Assignee: Denso Corporation, Kariya (JP)

( * ) Notice: Subject to any disclaimer, the term of this patent is extended or adjusted under 35 U.S.C. 154(b) by 17 days.

(21) Appl. No.: 09/991,987

(22) Filed: Nov. 26, 2001

(65) Prior Publication Data

US 2002/0062821 A1 May 30, 2002

(30) Foreign Application Priority Data

Nov. 27, 2000 (JP) ..... 2000-364527

(51) Int. Cl.[7] ..... F02M 37/04
(52) U.S. Cl. ..... 123/520; 123/198 D
(58) Field of Search ..... 123/516, 518, 123/519, 520, 198 D

(56) References Cited

U.S. PATENT DOCUMENTS 5,193,512 A 3/1993 Steinbrenner et al.
5,261,379 A * 11/1993 Lipinski et al. ..... 123/520
5,295,472 A * 3/1994 Otsuka et al. ..... 123/520
5,315,980 A * 5/1994 Otsuka et al. ..... 123/520
5,317,909 A 6/1994 Yamada et al.
5,327,873 A * 7/1994 Ohuchi et al. ..... 123/520
5,333,589 A * 8/1994 Otsuka ..... 123/520
5,398,661 A * 3/1995 Denz et al. ..... 123/520
5,400,759 A * 3/1995 Ishida ..... 123/520
5,448,980 A * 9/1995 Kawamura et al. ..... 123/520
5,499,613 A * 3/1996 Bayerle et al. ..... 123/520
5,996,400 A * 12/1999 Nishioka et al. ..... 73/40.5
6,082,337 A * 7/2000 Fujimoto et al. ..... 123/520
6,216,674 B1 * 4/2001 Corkill ..... 123/520
6,354,143 B1 * 3/2002 Isobe et al. ..... 73/118.1

* cited by examiner

*Primary Examiner*—Thomas N. Moulis
(74) *Attorney, Agent, or Firm*—Nixon & Vanderhye P.C.

(57) ABSTRACT

In a diagnosis apparatus, when tank internal pressure does not decrease up to a given negative pressure at a time when a given time has lapsed after starting negative pressure introduction into an evaporation gas purge system line, it is determined that the purge system line is abnormal and the abnormal cause is determined based on the internal pressure change amount $\Delta P$. The diagnosis apparatus identifies a valve opening state locking of an atmosphere change over valve, if $\Delta P > K2$, a valve closing state locking of a purge control valve, if $\Delta P \leqq K2$, and a large amount of leakage, if $K1 < \Delta P \leqq K2$. The internal pressure change amount $\Delta P$ is detected during a normal driving operation, at which the purge control valve is intermittently driven to intermittently purge the evaporation gas in a state that the atmosphere change over valve is opened.

10 Claims, 8 Drawing Sheets

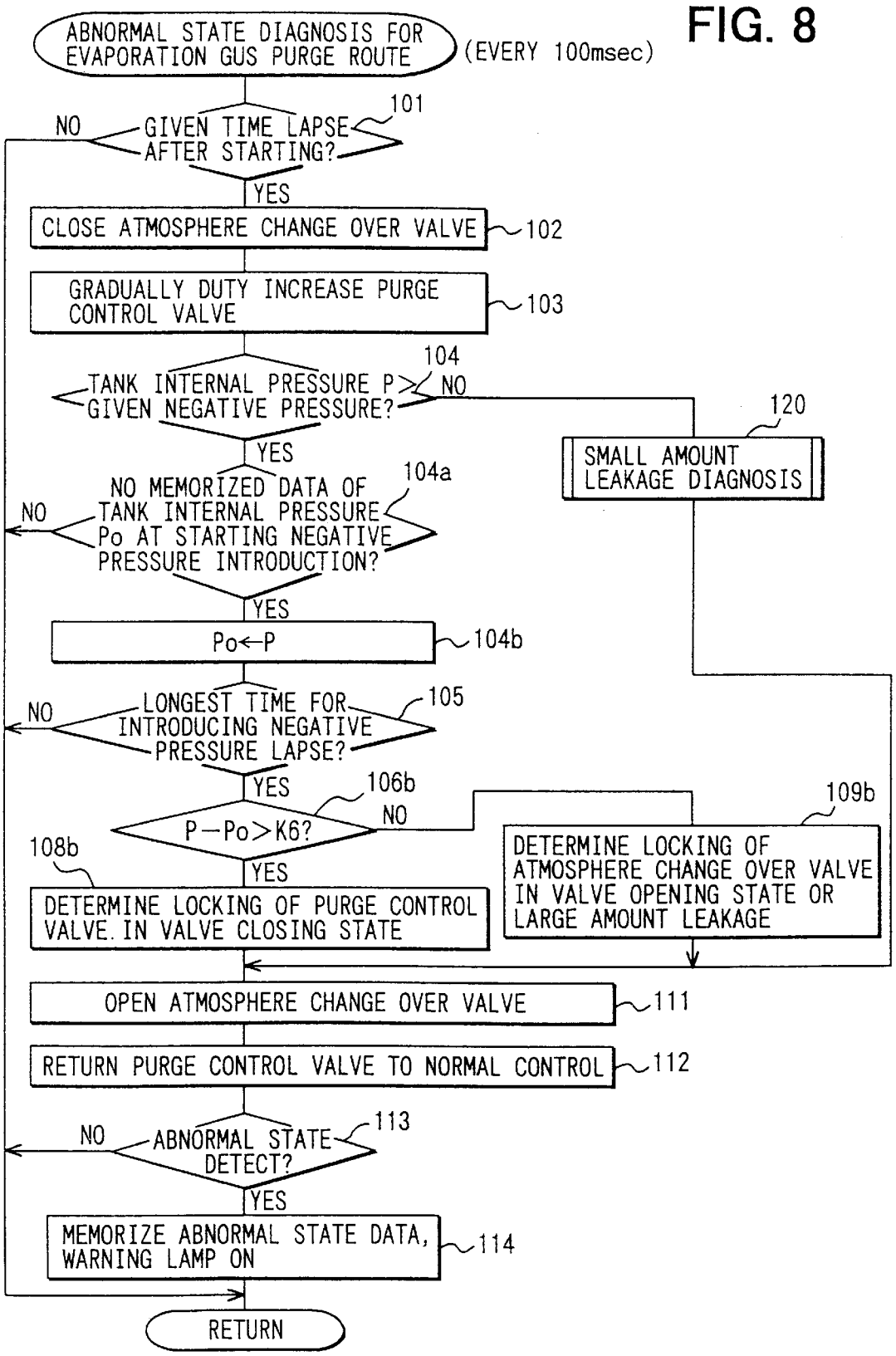
FIG. 8
ABNORMAL STATE DIAGNOSIS FOR EVAPORATION GUS PURGE ROUTE
(EVERY 100msec)
GIVEN TIME LAPSE AFTER STARTING?
101
NO
YES
CLOSE ATMOSPHERE CHANGE OVER VALVE
102
GRADUALLY DUTY INCREASE PURGE CONTROL VALVE
103
TANK INTERNAL PRESSURE P> GIVEN NEGATIVE PRESSURE?
104
NO
YES
SMALL AMOUNT LEAKAGE DIAGNOSIS
120
NO MEMORIZED DATA OF TANK INTERNAL PRESSURE Po AT STARTING NEGATIVE PRESSURE INTRODUCTION?
104a
NO
YES
Po←P
104b
LONGEST TIME FOR INTRODUCING NEGATIVE PRESSURE LAPSE?
105
NO
YES
P−Po>K6?
106b
NO
YES
DETERMINE LOCKING OF ATMOSPHERE CHANGE OVER VALVE IN VALVE OPENING STATE OR LARGE AMOUNT LEAKAGE
109b
DETERMINE LOCKING OF PURGE CONTROL VALVE. IN VALVE CLOSING STATE
108b
OPEN ATMOSPHERE CHANGE OVER VALVE
111
RETURN PURGE CONTROL VALVE TO NORMAL CONTROL
112
ABNORMAL STATE DETECT?
113
NO
YES
MEMORIZE ABNORMAL STATE DATA, WARNING LAMP ON
114
RETURN

DIAGNOSIS APPARATUS FOR DETECTING ABNORMAL STATE OF EVAPORATION GAS PURGE SYSTEM

CROSS REFERENCE TO RELATED APPLICATION

This application is based upon and claims the benefit of priority of Japanese Patent Application No. 2000-364527 filed on Nov. 27, 2000, the content of which is incorporated herein by reference.

BACKGROUND OF THE INVENTION

1. Field of the Invention

The present invention relates to a diagnosis apparatus for detecting an abnormal state of an evaporation gas purge system in which an evaporation fuel gas generated in a fuel tank is purged to an intake pipe of an internal combustion engine.

2. Description of Related Art

In a conventional evaporation gas purge system, to prevent an evaporation gas generated in a fuel tank from leaking into an atmosphere, the evaporation gas is adsorbed via an evaporation passage in a canister and, then, the evaporation gas adsorbed in the canister is purged via a purge passage to an intake pipe by regulating an opening and closing timing of a purge control valve provided in the purge passage according to operating conditions of an internal combustion engine so that a purge amount of the evaporation gas from the canister to the intake pipe is controlled. It is necessary to detect a leakage of the evaporation gas as soon as possible not to ignore an abnormal state that the evaporation gas leaks from the evaporation gas purge system to the atmosphere for a long time.

According to a conventional diagnosis apparatus, an evaporation gas purge system line is completely closed during a given time period in such a manner that an atmosphere change over valve closes a conduit communicating with atmosphere and, after the purge control valve is once opened so as to introduce negative pressure from the intake pipe to the fuel tank, the purge control valve is closed. A pressure sensor provided in the fuel tank detects a change amount of the pressure inside the fuel tank (tank internal pressure change amount) during the given time period when the evaporation gas purge system line is completely closed. Whether or not the gas leakage occurs in the evaporation gas purge system line is detected by comparing the tank internal pressure change amount with a threshold value for determination. According to the conventional method, unless the gas leakage occurs in the evaporation gas purge system line, the tank internal pressure change amount during the given time period, which is a value corresponding to a generation amount of the evaporation gas, is lower than the threshold value and, if the gas leakage occurs, the tank internal pressure change amount after the negative pressure is introduced, which increases by a value corresponding to the gas leakage, is higher than the threshold value.

According to the conventional diagnosis apparatus, the abnormal state of the evaporation gas purge system is detected under an assumption that the purge control valve and the atmosphere change over valve are always accurately operated. However, there is a possibility that each operation of the purge control valve and the atmosphere change over valve becomes abnormal. If the operation of the purge control valve or the atmosphere change over valve is abnormal, the leakage can not be accurately detected.

To cope with this problem, as disclosed in Japanese Pat. No. 3036703, a diagnosis method is proposed in which the purge control valve is judged to be abnormal unless a given value of the negative pressure is introduced into the fuel tank at a time of the negative pressure introduction. However, abnormal causes why the negative pressure is not accurately introduced into the fuel tank are not only due to the abnormal operation of the purge control valve but also due to the abnormal operation of the atmosphere change over valve or due to an aperture or gap, through which gas leaks, incidentally made in the evaporation gas purge system line. Therefore, according to this diagnosis method, the purge control valve whose operation is normal is sometimes misjudged as abnormal.

SUMMARY OF THE INVENTION

An object of the invention is to provide a diagnosis apparatus for detecting an abnormal state of an evaporation gas purge system in which, when an abnormality occurs in the evaporation gas purge system line, its abnormal cause is identified.

To achieve the above object, a diagnosis apparatus for detecting an abnormal state of an evaporation gas purge system line has a passage connecting between a fuel tank and an intake pipe for an internal combustion engine, a canister disposed in the passage for adsorbing evaporation fuel gas from the fuel tank, a purge control valve for controlling a purge of the evaporation fuel gas from the canister to the intake pipe and an atmosphere change over valve for opening and closing an atmosphere communication hole of the canister.

The diagnosis apparatus has pressure detecting means for detecting a tank internal pressure of the fuel tank and abnormal state detecting means for judging an existence of the abnormal state by detecting a fact that, when the purge control valve is opened to introduce a negative pressure from the intake pipe to the fuel tank via the passage in a state that the atmosphere change over valve is closed, the tank internal pressure detected by the pressure detecting means does not decrease up to a given negative pressure at a time when a given time has lapsed after opening the purge control valve. The diagnosis apparatus further has abnormal cause determining means for identifying the at least one of abnormal causes based on the tank internal pressure detected by the pressure detecting means when the existence of the abnormal state thereof is judged by the abnormal state detecting means.

With the diagnosis apparatus mentioned above, at least one of abnormal causes may be identified among a valve closing lock of the purge control valve, a valve opening lock of the atmosphere change over valve and a large amount leakage that the evaporation fuel gas leaks to atmosphere from a portion other than the atmosphere communication hole.

As an alternative, the diagnosis apparatus may have pressure detecting means for detecting a tank internal pressure of the fuel tank and abnormal state identifying means. The abnormal state identifying means determines the abnormal state as the valve closing locking of the purge control valve, if the tank internal pressure detected by the pressure detecting means increases, when the purge control valve is opened to introduce a negative pressure from the intake pipe to the fuel tank via the passage in a state that the atmosphere change over valve is closed.

It is preferable that the abnormal cause determining means has calculation means calculating a change amount of the tank internal pressure during a given period or calculation means calculating an integration value of the tank internal pressure during another given period, and comparing means for comparing the change amount or the integration value with at least one of threshold values so that at least one of the abnormal causes is identified.

Preferably, the change amount or the integration value is calculated when the, internal combustion engine is operated in a driving range in which the purge control valve is intermittently opened to intermittently purge the evaporation fuel gas from the canister to the intake pipe in a state that the atmosphere change over valve is opened.

The comparing means determines the abnormal cause as the valve closing state locking of the purge control valve when the change amount is not larger than a first given value representing the at least one of threshold values or when the integration value is not smaller than a second given value representing the at least one of threshold values.

Further, the comparing means determines the valve opening state locking of the atmosphere change over valve when the change amount is larger than a third given value among the threshold values, which is larger than the first given value, or when the integration value is smaller than a fourth given value among the threshold values, which is smaller than the second given value.

Moreover, the comparing means determines the large amount leakage when the change amount is larger than the first given value but is not larger than the third given value or when the integration value is not smaller than the fourth given value but smaller than the second given value.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

FIG. 8 is a flow chart showing process sequences of an abnormal state diagnosis program for an evaporation gas purge system line according to a third embodiment;

DETAILED DESCRIPTION OF THE PREFERRED EMBODIMENTS

First Embodiment

Figure 1:
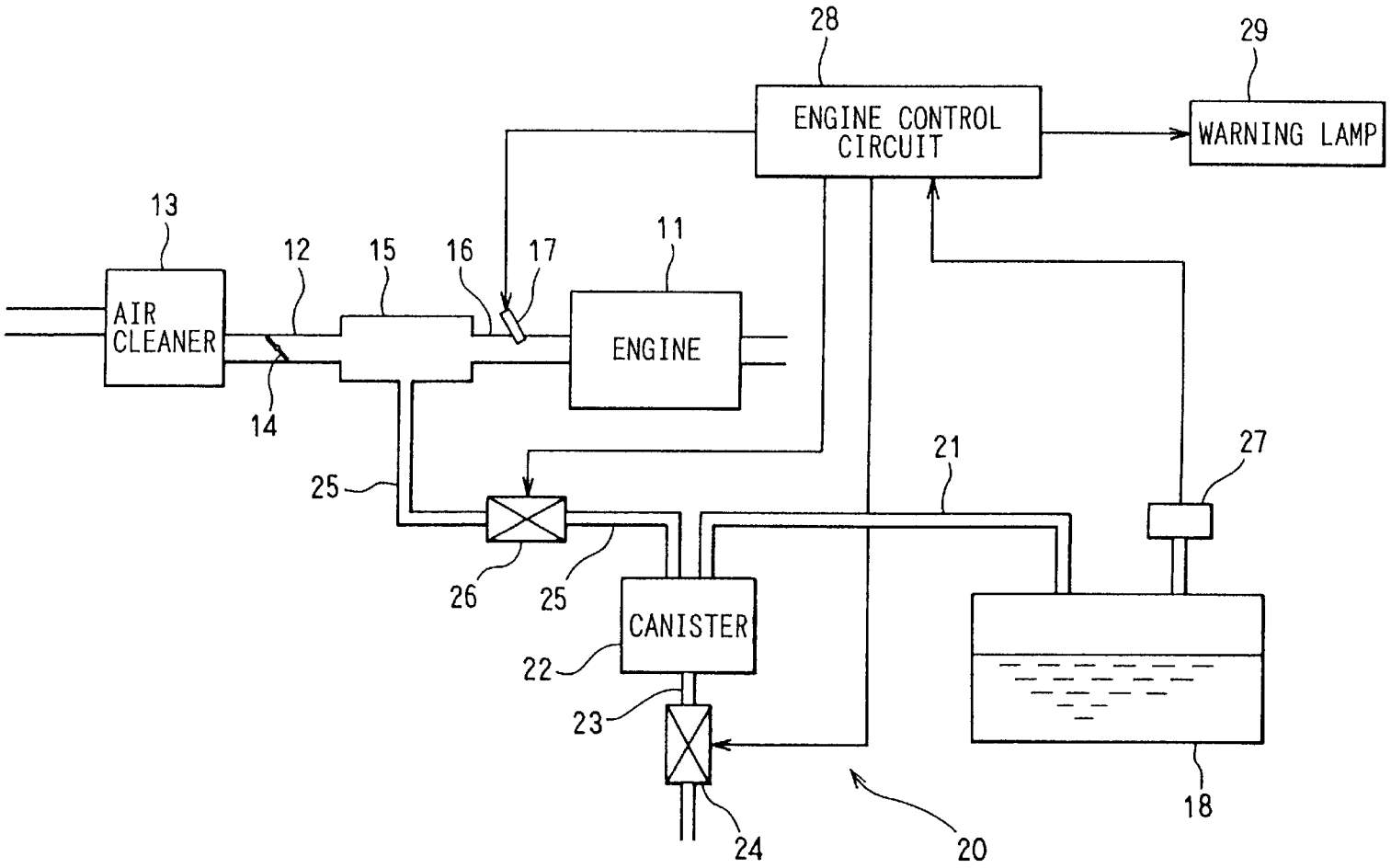
FIG. 1 is a view showing an outline of an entire structure of a fuel system according to a first embodiment of the present invention.

A first embodiment of the present invention is described with reference to FIGS. 1 to 5. FIG. 1 shows an outline of an entire structure of a fuel system.

An air cleaner 13 is provided on an upstream side of an intake pipe 12 of an internal combustion engine 11. An air passing through the air cleaner 13 flows via a throttle valve 14 to a surge tank 15 of the intake pipe 12 and, then, through respective intake manifolds 16 of the intake pipe 12, to respective cylinders of the engine 11. Each of the intake manifolds 16 is provided with a fuel injection valve 17 corresponding to each of the cylinders. Fuel in a fuel tank 18 is delivered to each of the fuel injection valves 17 through fuel pipes (not shown) by a fuel pump (not shown).

Next, a structure of an evaporation gas purge system 20 is described. A canister 22 is connected via an evaporation passage 21 to the fuel tank 18. The canister 22 is provided inside with an adsorbent (not shown) such as charcoal that adsorbs evaporation fuel gas. An atmosphere communication conduit 23 is connected with an atmosphere communication hole formed at a bottom of the canister 22. The atmosphere communication conduit 23 is provided with an atmosphere change over valve 24.

The atmosphere change over valve 24 is composed of a normally open solenoid valve. The solenoid valve is kept in a valve opening state, when de-energized, so that the atmosphere communication conduit 23 is opened to the atmosphere and turns to a valve closing state, when energized, so that the atmosphere communication conduit 23 is closed.

A purge passage 25 for purging the evaporation gas adsorbed in the adsorbent inside the canister 22 connects the surge tank 15 and the canister 22. A purge control valve 26 for regulating a flow amount of the evaporation gas is disposed in the purge passage 25. The purge control valve 26 is composed of a normally closed solenoid valve and operative to control the flow amount of the evaporation gas purged from the canister 22 to the intake pipe 12 with a duty control of current applied thereto.

A pressure sensor 27 (pressure detecting means) for detecting internal pressure of the fuel tank 18 is provided in the fuel tank 18. When an evaporation gas purge system line from the fuel tank 18 to the purge control valve 26 is completely closed, the internal pressure of the fuel tank 18 is equal to internal pressure of any portion in the evaporation gas purge system line. Accordingly, the pressure of the evaporation gas purge system line can be detected by sensing the internal pressure of the fuel tank 18.

An output signal of the pressure sensor 27 is read in an engine control circuit 28. The engine control circuit 28 is composed mainly of a microcomputer and executes a fuel injection control program, an ignition control program and a purge control program, which are memorized in ROM of the microcomputer, so that a fuel injection control, an ignition control and a purge control are performed. Further, the engine control circuit 28 executes a diagnosis program for detecting an abnormal state of the evaporation gas purge system line, which is memorized in ROM and shown in FIGS. 2 and 3, so that whether or not the abnormal state of the evaporation gas purge system line occurs is determined and, when the abnormal state is determined, identifies an abnormal cause. Moreover, the engine control circuit 28 executes a diagnosis program for detecting a small amount of evaporation gas leakage as shown in FIG. 4 so that whether or not the small amount of evaporation gas leakage occurs is determined and, when the leakage is determined, a warning lamp 29 is lit on for warning a driver.

An abnormal state diagnosis program for the evaporation gas purge system line is described below.

Figure 2:
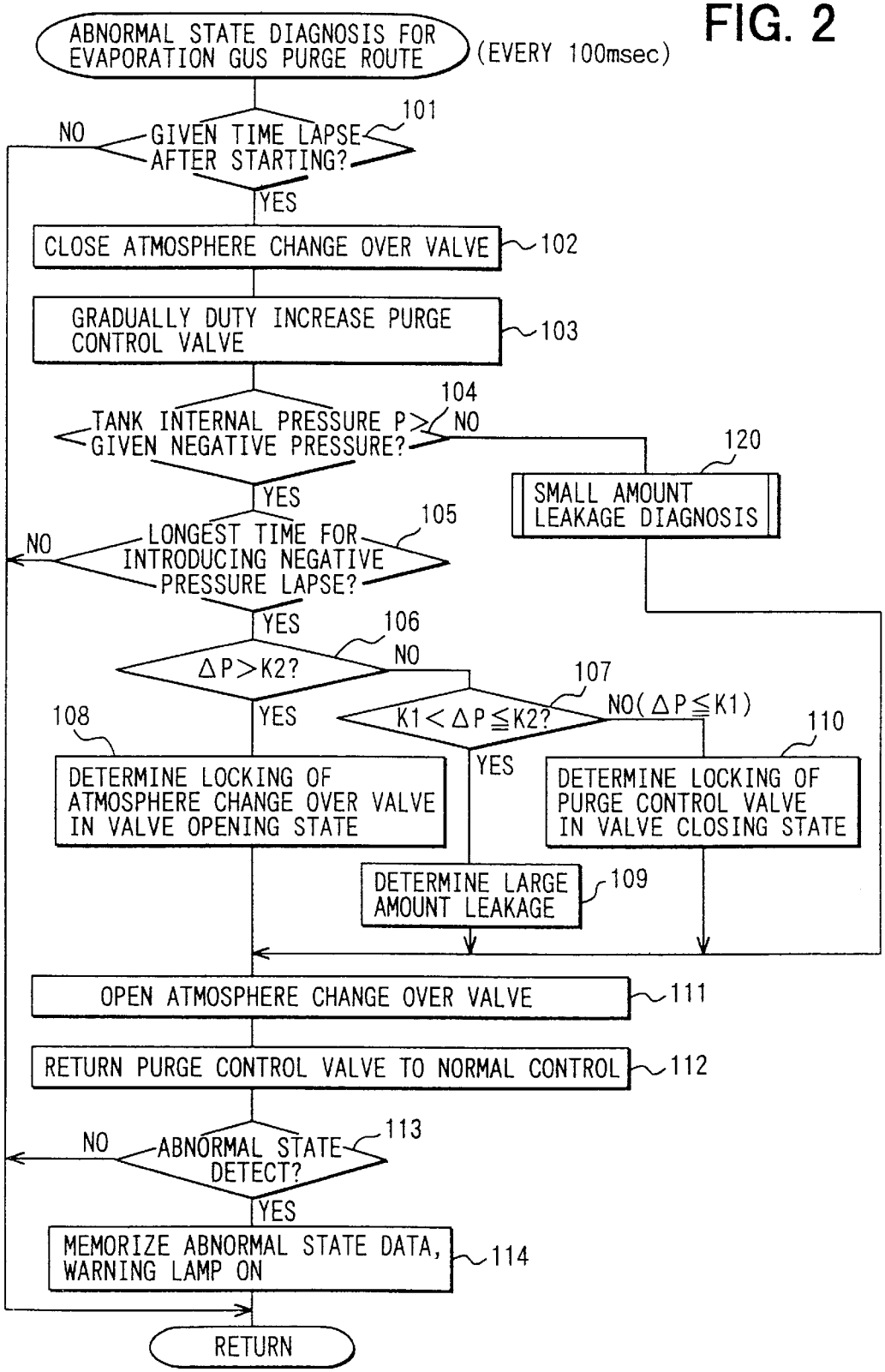
FIG. 2 is a flow chart showing process sequences of an abnormal state diagnosis program for an evaporation gas purge system line according to the first embodiment.

The abnormal state diagnosis program for the evaporation gas purge system line shown in FIG. 2 starts and is executed every a given time (for example, every 100 msec) after an ignition switch (not shown) turns on. After starting the program, Step 101 determines whether or not a given time (for example, 300 sec) necessary for detecting a change amount of a tank internal pressure P has already lapsed and, unless the given time has lapsed, the program ends without going to the subsequent abnormal state diagnosis processes at and after Step 102.

If the given time has lapsed, the abnormal state diagnosis processes at and after Step 102 are executed below. At Step 102, the atmosphere change over valve 24 is closed so that the atmosphere communication conduit 23 of the canister 22 is closed. Then, the process is forwarded to Step 103 where a duty ratio of driving current to the purge control valve 26 is gradually increased so as to gradually increase the negative pressure introduced from the surge tank 15 of the intake pipe 12 to the evaporation gas purge system line.

Step 104 determines whether or not the tank internal pressure P sensed by the pressure sensor 27 is below a given negative pressure (for example, −1.5 kPa (gauge pressure)) and, if the pressure P is below the given negative pressure, the process goes to Step 120 where a small amount leakage diagnosis program as shown in FIG. 4 is executed to detect a small amount leakage from the evaporation gas purge system line.

Unless the pressure P is below the given negative pressure, the process goes to Step 120 at which whether or not a longest time for introducing negative pressure has already lapsed after the valve opening of purge control valve 26 (after starting the negative pressure introduction) is determined. The longest time for introducing negative pressure is set to a given time (for example, 30 sec) sufficient for the tank internal pressure P to become below the given negative pressure when no leakage occurs or the small amount leakage occurs.

If the tank internal pressure P becomes below the given negative pressure before the longest time for introducing the negative pressure lapses after starting the negative pressure introduction, the process is immediately forwarded to the Step 120. Unless the tank internal pressure P is below the given negative pressure before the longest time for introducing the negative pressure lapses after starting the negative pressure introduction, the program ends without executing the subsequent processes so that the negative pressure introduction continues.

Figure 5:
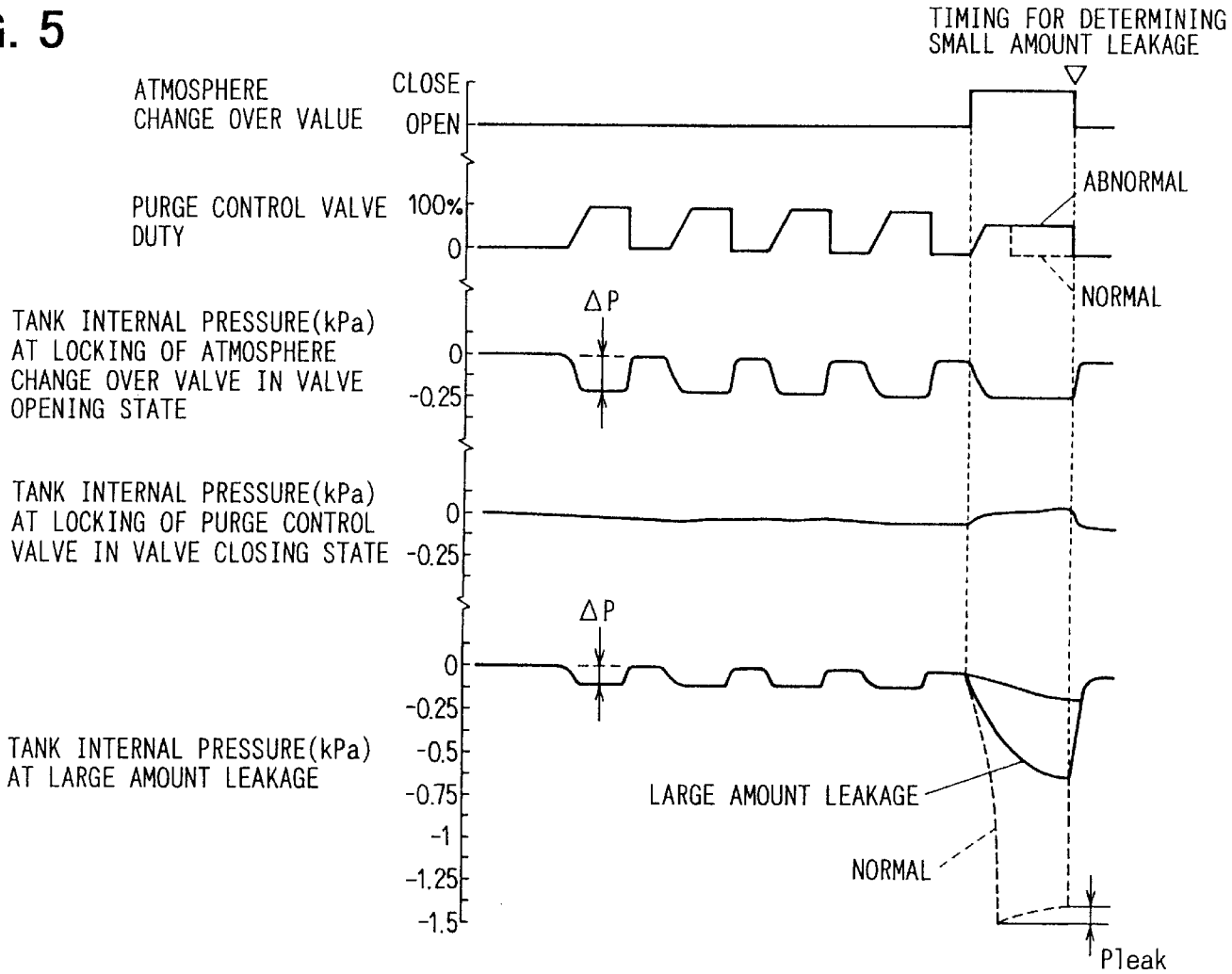
FIG. 5 is a time chart on executing an abnormal state diagnosis for the evaporation gas purge system line according to the first embodiment.

If the tank internal pressure P does not decrease up to the given negative pressure even after the longest time for introducing the negative pressure has lapsed after starting the negative pressure introduction, it is judged that the evaporation gas purge system line is in an abnormal state and the abnormal cause is determined based on a tank internal pressure change amount ΔP according to Steps 106 to 110. The tank internal pressure change amount ΔP is calculated based on a tank internal pressure change amount calculation program shown in FIG. 3 during a normal driving operation before starting the negative pressure introduction (before starting the abnormal state diagnosis). As shown in FIG. 5, during the normal driving operation before starting the negative pressure introduction, the purge control valve 26 is driven to intermittently repeat the valve opening so as to intermittently execute the purge in a state that the atmosphere change over valve 24 is opened. Accordingly, the tank internal pressure change amount ΔP, which is calculated during the normal driving operation before starting the negative pressure introduction, corresponds to the change amount of the tank internal pressure P generated when the purge control valve 26 is opened and closed in a state that the atmosphere change over valve 24 is opened.

If the purge control valve 26 is normally opened and closed in a state that the atmosphere change over valve 24 is normally opened during a time period when the tank internal pressure change amount ΔP is detected, a value of the tank internal pressure change amount ΔP is large. However, if the purge control valve 26 is locked in a valve closing state, the value of the tank internal pressure change amount ΔP shows a minimum value (about 0) since the negative pressure is not introduced at all to the fuel tank 18. Accordingly, it can be judged that the purge control valve 26 is locked in a valve closing state when the value of the tank internal pressure change amount ΔP shows the minimum value.

Further, if the value of the tank internal pressure change amount ΔP is larger than the minimum value but smaller than a value of the change amount at a time when the purge control valve 26 is normally operated, it can be presumed that a larger amount leakage occurs, compared to a small amount leakage subject to the small amount leakage diagnosis.

When the atmosphere change over valve 24 is locked in a valve opening state, the value of the tank internal pressure change amount ΔP is still large, similar to the change amount at a time when the purge control valve 26 is normally operated. However, in this case, the tank internal pressure P does not decrease up to the given negative pressure on executing the abnormal state diagnosis. Accordingly, when the value of the tank internal pressure change amount ΔP is large and the tank internal pressure P does not decrease up to the given negative pressure at the abnormal state diagnosis, it can be judged that the atmosphere change over valve 24 is locked in the valve opening state.

In the program shown in FIG. 2, two threshold values K1 and K2 are set for identifying the respective three abnormal causes mentioned above based on the tank internal pressure change amount ΔP. When the tank internal pressure P does not decreases up to the given negative pressure, the value of the tank internal pressure change amount ΔP is compared with the threshold K2, which is larger than the threshold K1, at Step 106 and, if determined to be larger than the threshold K2, the process goes to Step 108 where it is judged that the atmosphere change over valve 24 is locked in the valve opening state.

If the value of the tank internal pressure change amount ΔP is determined not to be larger than the threshold K2 at Step 106, the process goes to Step 107 which determines whether or not the value of the tank internal pressure change amount ΔP is larger than the threshold K1, that is, whether a relationship, $K1<\Delta P\leqq K2$, is satisfied and, if satisfied, the process goes to Step 109 which judges as the large amount leakage.

After the abnormal causes are determined as mentioned above, the process goes to Step 111 where the atmosphere change over valve 24 is opened. Then, at Step 112, the purge control valve 26 is returned to a normal control state. Further, Step 113 determines whether or not the abnormal state of the evaporation gas purge system line has been detected at Steps 108 to 110 or at Step 120 and, if determines that the abnormal state has been detected, the process goes to Step 114 where data of the abnormal state is memorized and a warning lamp 29 is lit on.

Each of the thresholds K1 and K2 may be a fixed value for simplifying the calculation process mentioned above or may be a variable value calculated according to a map or a formula based on a remaining fuel amount in the fuel tank 18 (air volume in the evaporation gas purge system line). If each value of the thresholds K1 and K2 is variable as mentioned above, the abnormal causes are more accurately identified by eliminating an influence of the value change of the tank internal pressure change amount ΔP based on the remaining fuel amount in the fuel tank 18 (the air volume in the evaporation gas purge system line).

A calculation program of the tank internal pressure change amount is described below.

Figure 3:
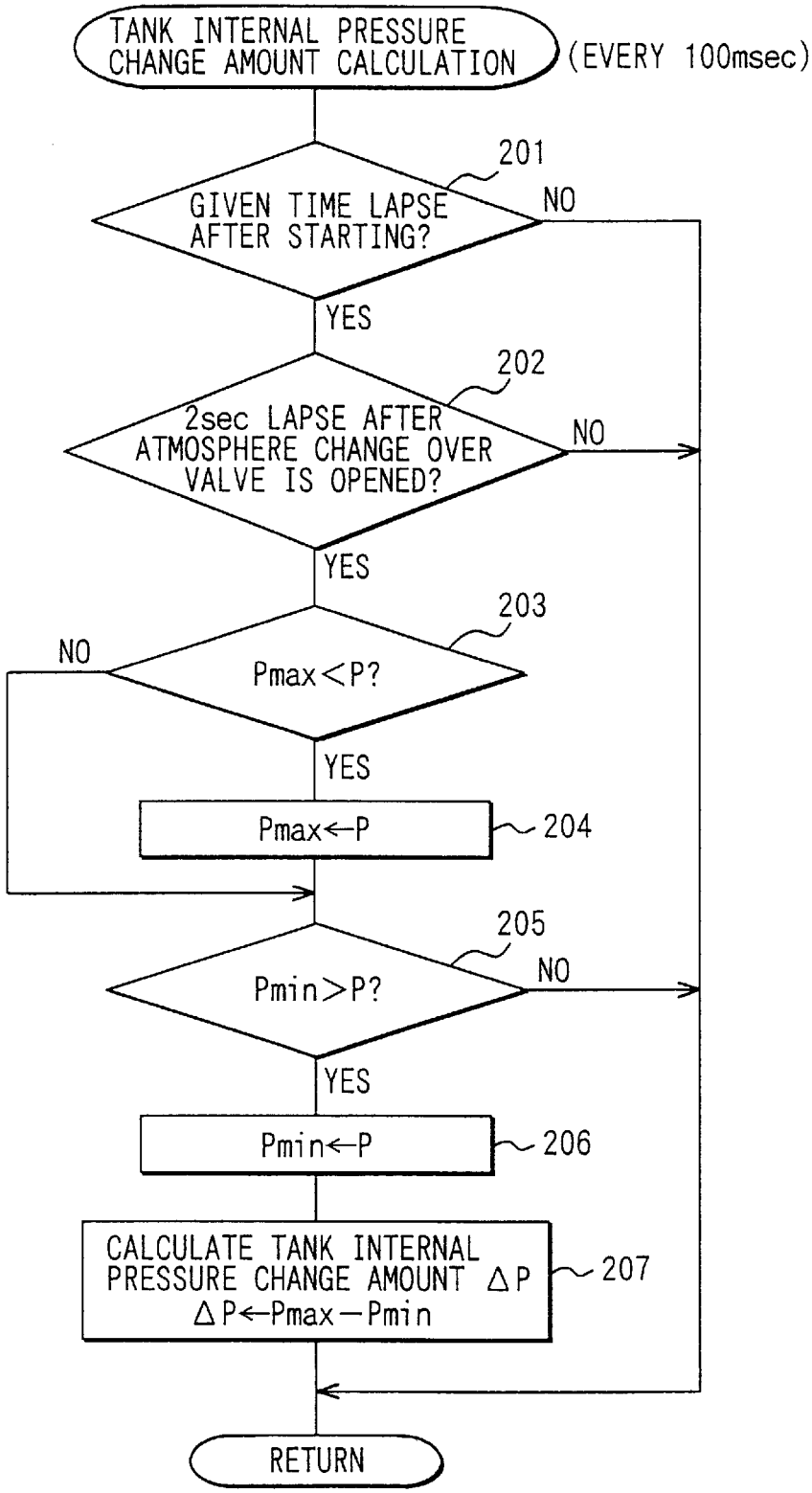
FIG. 3 is a flow chart showing process sequences of a calculation program for a tank internal pressure change amount according to the first embodiment.
Figure 4:
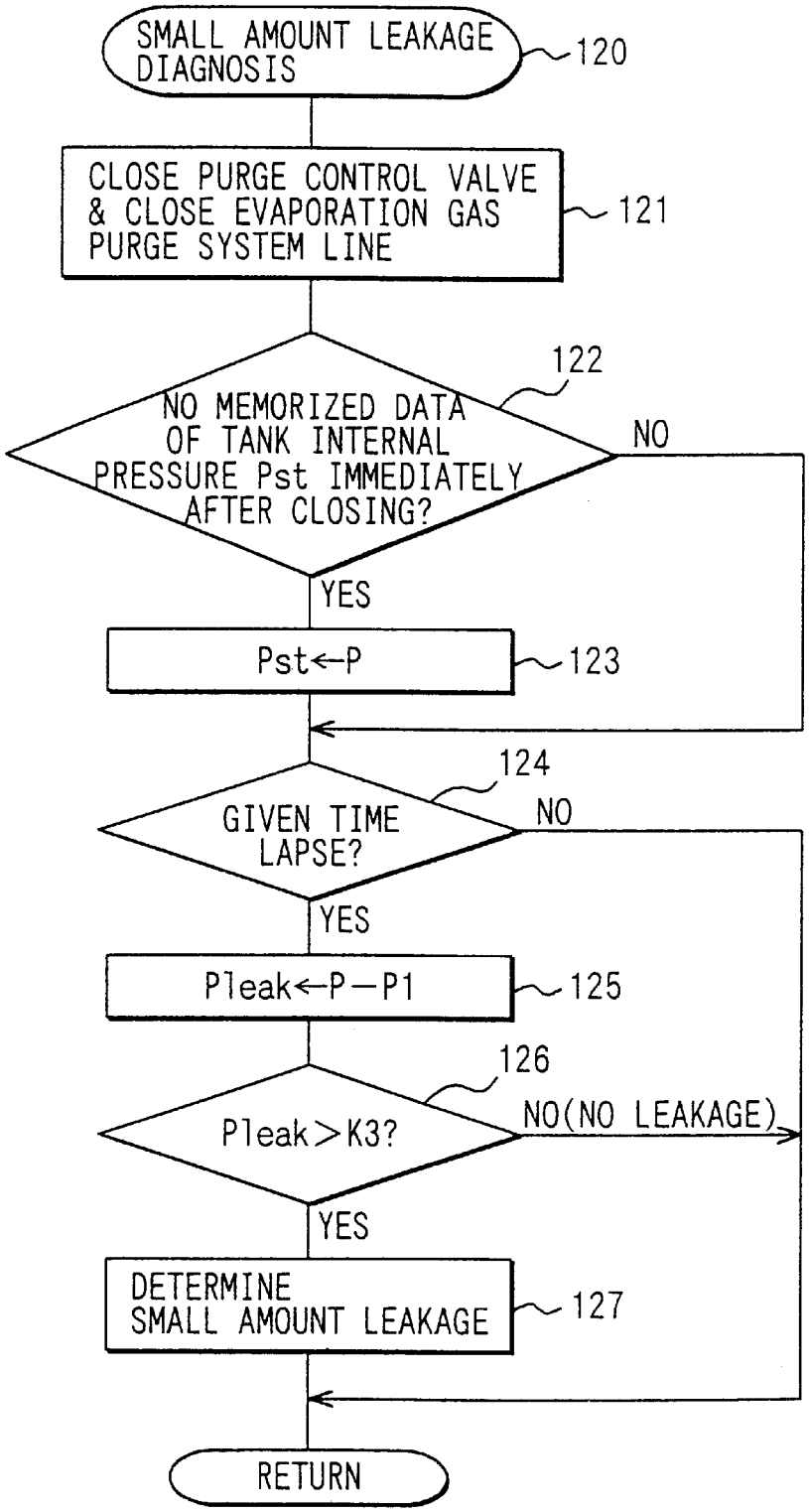
FIG. 4 is a flow chart showing process sequences of a small amount leakage diagnosis program according to the first embodiment.

The calculation program of the tank internal pressure change amount shown in FIG. 3 starts and is executed every a given time (for example, every 100 msec) after an ignition switch (not shown) turns on. After starting the program, Step 201 determines whether or not a given time (for example, 60 sec), which is necessary for intake pressure in the intake pipe 12 to become stable after starting, has already lapsed and, unless determines that the given time has lapsed, the program ends without going to Step 202.

If the given time has lapsed after starting, the process goes to Step 202, which determines whether or not a given time (for example, 2 sec) has lapsed after the atmosphere change over valve 24 is opened, that is, whether or not the tank internal pressure P is stable, and, unless determine that the given time has lapsed, the program ends without going to Step 203.

When the given time (2 sec) has lapsed after the atmosphere change over valve 24 is opened, the process goes to Step 203 where a maximum value Pmax and a minimum value Pmin of the tank internal pressure P are detected. At Step 203, a current value of the tank internal pressure P is compared with the maximum value Pmax (stored in a memory) based on the previous values of the tank internal pressure P and if the current value of the tank internal pressure P is higher than the memorized maximum value pmax, the process goes to Step 204 where the memorized maximum value Pmax is renewed by the current value of the tank internal pressure P. Further, at Step 204, the current value of the tank internal pressure P is compared with the minimum value Pmin (stored in a memory) based on the previous values of the tank internal pressure P and if the current value of the tank internal pressure P is lower than the memorized minimum value Pmin, the process goes to Step 206 where the memorized minimum value Pmin is renewed by the current value of the tank internal pressure P.

Then, at Step 207, the tank internal pressure change amount ΔP is calculated by subtracting the memorized minimum value Pmin from the memorized maximum value Pmax.

A small amount leakage program is described below.

The small amount leakage program shown in FIG. 4 is a subroutine executed at Step 120 of the diagnosis program for detecting the abnormal state of the evaporation gas purge system line shown in FIG. 2. Therefore, this program is executed at a time when the tank internal pressure P decreases up to the given negative pressure (for example, −1.5 kPa (gauge pressure)) due to the negative pressure introduction. At Step 121, the purge control valve 26 is closed so that the negative pressure introduction ends and the evaporation gas purge system line is completely closed.

At Steps 122 and 123, a tank internal pressure Pst immediately after the evaporation gas purge system line is completely closed is memorized. Then, Step 124 determines whether or not a given time (for example, 15 sec) has lapsed after the evaporation gas purge system line is completely closed and, if determine that the given time has lapsed, the process goes to Step 125 where a tank internal pressure change amount Pleak during a period when the evaporation gas purge system line is completely closed is calculated as follows in use of the current value of the tank internal pressure P and the memorized value Pst of the tank internal pressure immediately after the evaporation gas purge system line is completely closed.

$$\text{Pleak}=P-Pst$$

At Step 126, the tank internal pressure change amount Pleak is compared with a given threshold K3 and, if Pleak is larger than K3, the process goes to Step 127 which judges that there occurs the small amount leakage. At Step 126, unless Pleak is larger than K3, this program ends under a judgment that there is no small amount leakage (normal).

The threshold K3 may be a fixed value for simplifying the calculation process mentioned above or may be a variable value calculated according to a map or a formula based on a remaining fuel amount in the fuel tank 18 (air volume in the evaporation gas purge system line).

According to the first embodiment mentioned above, If the tank internal pressure P does not decrease up to the given negative pressure even after the longest time for introducing the negative pressure has lapsed after starting the negative pressure introduction, it is judged that the evaporation gas purge system line is in an abnormal state and the abnormal cause is determined based on a tank internal pressure change amount ΔP. Accordingly, what the abnormal cause is, due to a locking of the purge control valve 26 in the valve closing state, due to a locking of the atmosphere change over valve 24 in the valve opening state or due to the large amount leakage, is accurately identified.

Further, according to the first embodiment, when the purge control valve 26 is driven to intermittently repeat the valve opening so as to intermittently execute the purge in a state that the atmosphere change over valve 24 is opened during the normal driving operation before stating the abnormal state diagnosis (starting the negative pressure introduction), the tank internal pressure change amount ΔP, which is used as dada for identifying the abnormal causes, is calculated. Accordingly, when the abnormal state of the evaporation gas purge system line is detected at the abnormal state diagnosis, the abnormal cause is immediately identified in use of the tank internal pressure change amount ΔP detected before starting the abnormal state diagnosis.

However, the tank internal pressure change amount ΔP, which is used as dada for identifying the abnormal causes, may be detected after the abnormal state of the evaporation gas purge system line is detected. In this case, a given purpose of the present invention can be also completely satisfied.

Furthermore, according to the first embodiment, to identify the respective abnormal causes such as the locking of the purge control valve 26 in the valve closing state, the locking of the atmosphere change over valve 24 in the valve opening state and the large amount leakage, the two thresholds K1 and K2 are used to compare with the tank internal pressure change amount ΔP. However, three or more threshold values may be used to compare with the tank internal pressure change amount P to identify the abnormal causes.

Moreover, the diagnosis apparatus may detect and identify only two abnormal causes among the locking of the purge control valve 26 in the valve closing state, the locking of the atmosphere change over valve 24 in the valve opening state and the large amount leakage (for example, the locking of the purge control valve 26 in the valve closing state and the locking of the atmosphere change over valve 24 in the valve opening state).

Second Embodiment

Figure 6:
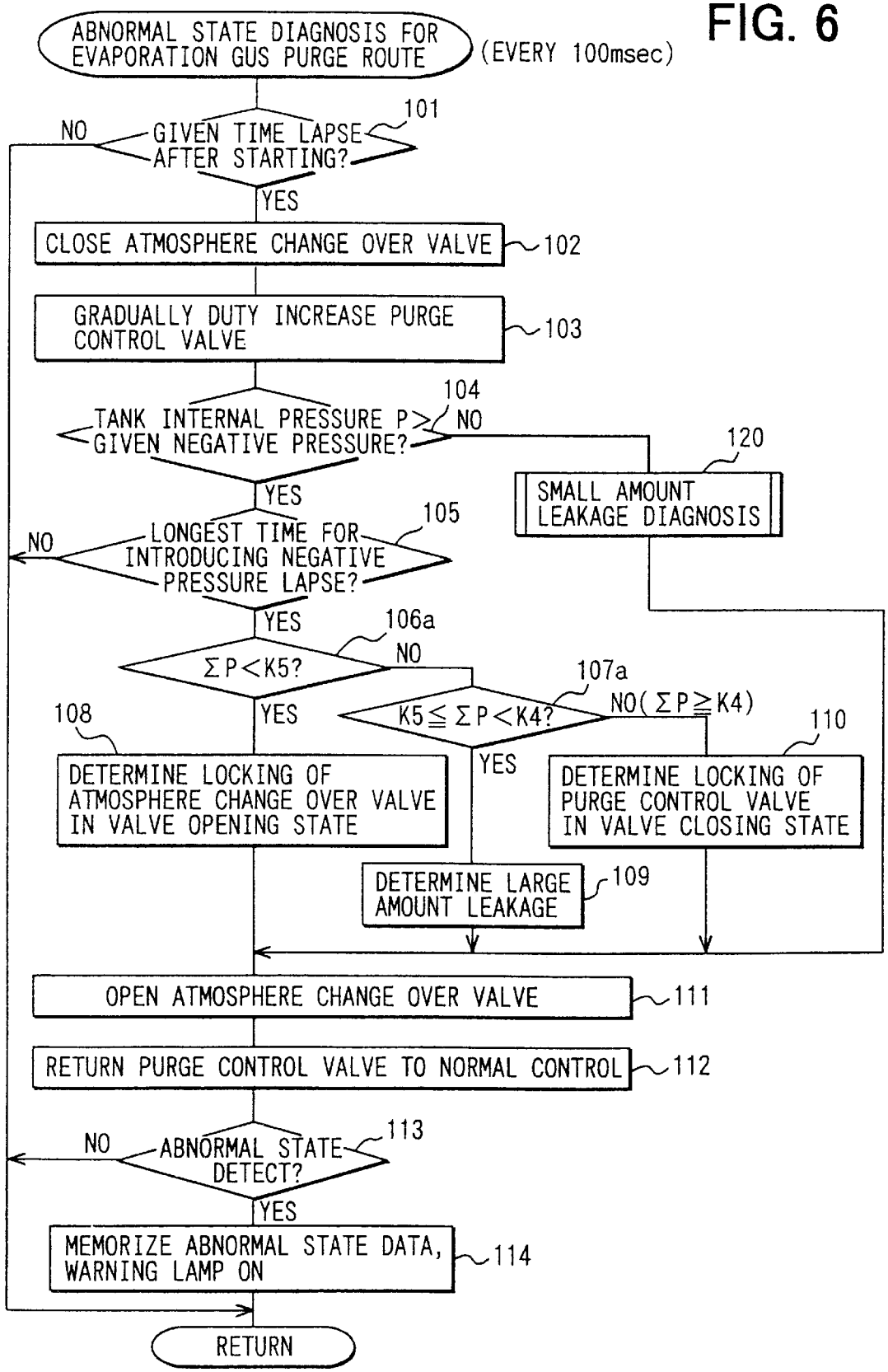
FIG. 6 is a flow chart showing process sequences of an abnormal state diagnosis program for an evaporation gas purge system line according to a second embodiment.
Figure 7:
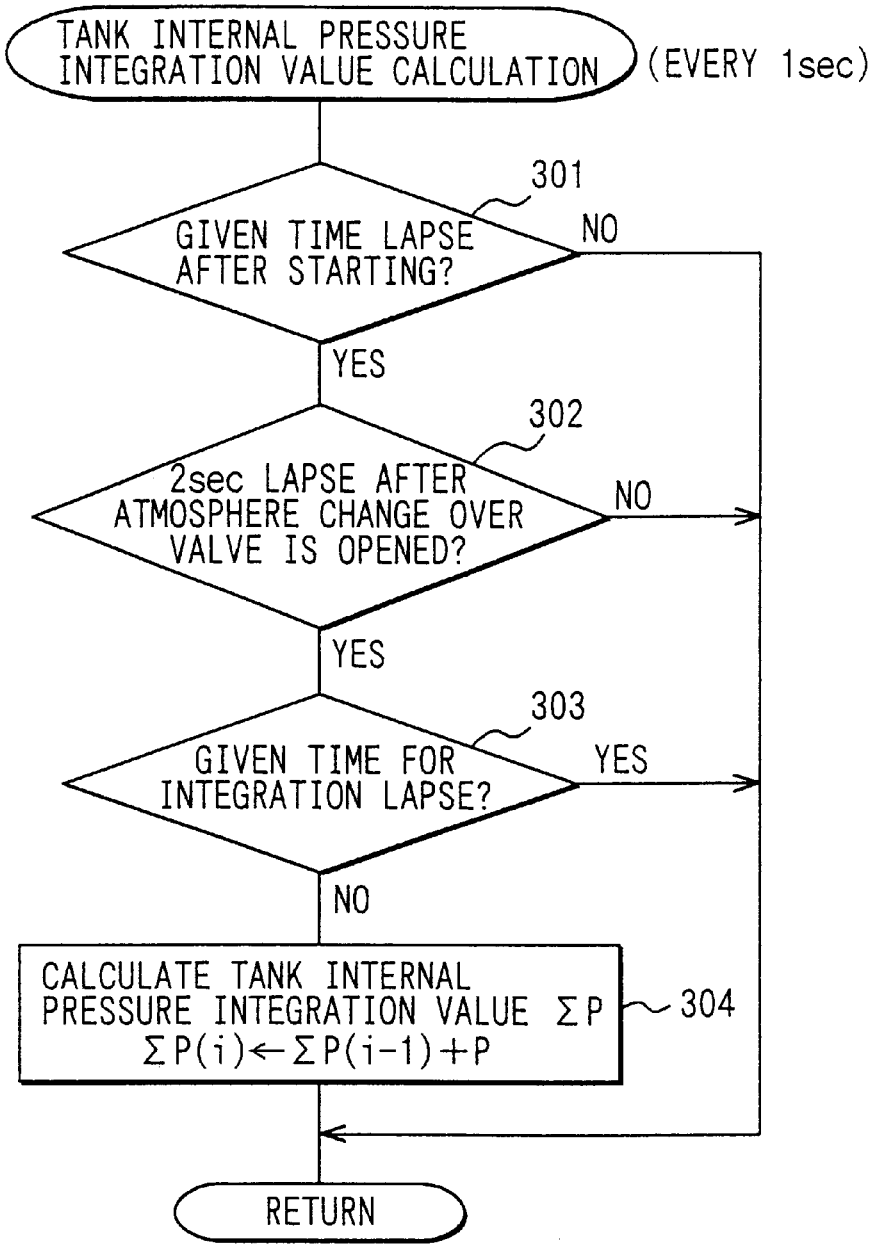
FIG. 7 is a flow chart showing process sequences of a calculation program for a tank internal pressure integration value according to the second embodiment.

According to a second embodiment as shown in process charts of FIGS. 6 and 7, the abnormal causes are determined based on an integration value ΣP of the tank internal pressure P instead of the tank internal pressure change amount ΔP according to the first embodiment. Program processes shown in FIGS. 6 and 7 are described below.

A diagnosis program for detecting the abnormal state of the evaporation gas purge system line shown in FIG. 6 has Steps 106*a* and 107*a* for identifying the abnormal causes, which are different from the Steps 106 and 107 shown in the program of FIG. 2, and the other Steps similar to the other steps shown in the program of FIG. 2. Accordingly, when the tank internal pressure P does not decrease up to the given negative pressure even if the longest time for introducing the negative pressure has lapsed after the negative pressure introduction starts, it is determined at Steps 101 to 105 that the evaporation gas purge system line is in an abnormal state. The abnormal cause is identified at Steps 106*a* and 107*a* based on the tank internal pressure integration value ΣP during a given time period (for example, 30 sec). The tank internal pressure integration value ΣP is calculated by a tank internal pressure integration value calculation program during a normal driving operation before starting the negative pressure introduction (before starting the abnormal state diagnosis). During the normal driving operation, before starting the negative pressure introduction, the purge control valve 26 is driven to intermittently repeat the valve opening so as to intermittently execute the purge in a state that the atmosphere change over valve 24 is opened. Accordingly, the tank internal pressure integration value ΣP, which is calculated during the normal driving operation before starting the negative pressure introduction, corresponds to the integration value of the tank internal pressure P generated when the purge control valve 26 is opened and closed in a state that the atmosphere change over valve 24 is opened.

When the purge control valve 26 is normally opened and closed in a state that the atmosphere change over valve 24 is normally opened during a time period when the tank internal pressure integration value ΣP is detected, a value of the tank internal pressure integration value ΣP is small. However, when the purge control valve 26 is locked in a valve closing state, the tank internal pressure integration value ΣP shows a maximum value since the negative pressure is not introduced at all to the fuel tank 18 so that the tank internal pressure P is kept high. Accordingly, it can be judged that the purge control valve 26 is locked in a valve closing state when the tank internal pressure integration value ΣP shows the maximum value.

Further, when the value of the tank internal pressure integration value ΣP is smaller than the maximum value but smaller than an integration value of the tank internal pressure at a time when the purge control valve 26 is normally operated, it can be presumed that a larger amount leakage occurs, compared to a small amount leakage subject to the small amount leakage diagnosis.

When the atmosphere change over valve 24 is locked in a valve opening state, the tank internal pressure integration value ΣP is still small, similar to the integration value of the tank internal pressure at a time when the purge control valve 26 is normally operated. However, in this case, the tank internal pressure P does not decrease up to the given negative pressure on executing the abnormal state diagnosis. Accordingly, when the tank internal pressure integration value ΣP is small and the tank internal pressure P does not decrease up to the given negative pressure at the abnormal state diagnosis, it can be judged that the atmosphere change over valve 24 is locked in the valve opening state.

In the program shown in FIG. 6, two threshold values K4 and K5 are set for identifying the respective three abnormal causes mentioned above based on the tank internal pressure integration value ΣP. When the tank internal pressure P does not decreases up to the given negative pressure, the tank internal pressure integration value ΣP is compared with the threshold KS, which is smaller than the threshold K4, at Step 106*a* and, if determined to be smaller than the threshold K5, the process goes to Step 108 where it is judged that the atmosphere change over valve 24 is locked in the valve opening state.

If the tank internal pressure integration value ΣP is determined not to be smaller than the threshold K5 at Step 106*a*, the process goes to Step 107*a* which determines whether or not the tank internal pressure integration value ΣP is smaller than the threshold K4, that is, whether a relationship, $K5 \leqq \Sigma P < K4$, is satisfied and, if satisfied, the process goes to Step 109 which judges as the large amount leakage.

If the tank internal pressure integration value ΣP is larger than the threshold K4, the process goes to Step 110 where it is judged that the purge control valve 26 is locked in the valve closing state.

Each of the thresholds K4 and K5 may be a fixed value for simplifying the calculation process mentioned above or may be a variable value calculated according to a map or a formula based on a remaining fuel amount in the fuel tank 18 (air volume in the evaporation gas purge system line).

A calculation program of the tank internal pressure integration value shown in FIG. 7 starts and is executed every a given time (for example, every 1 sec) after an ignition switch (not shown) turns on. After starting the program, Step 301 determines whether or not a given time (for example, 60 sec), which is necessary for intake pressure in the intake pipe 12 to become stable after starting, has already lapsed and, unless determines that the given time has lapsed, the program ends without going to Step 302.

If the given time has lapsed after starting, the process goes to Step 302, which determines whether or not a given time (for example, 2 sec) has lapsed after the atmosphere change over valve 24 is opened, that is, whether or not the tank internal pressure P is stable, and, unless determine that the given time has lapsed, the program ends without going to Step 303.

When the given time (2 sec) has lapsed after the atmosphere change over valve 24 is opened, the process goes to Step 303 which determines whether or not a given time for integration (for example, 30 sec) has lapsed. Unless the given time for integration has lapsed, the process goes to Step 304 where a current value of the tank internal pressure p is integrated into an immediately previous integration sum ΣP (i−1) of the tank internal pressure integration value so that a current tank internal pressure integration value ΣP (i) is obtained. This integration process is repeated every a given time (for example, 1 sec) until the given time for integration has lapsed so that the tank internal pressure integration value ΣP during the given time for integration is obtained.

The second embodiment has the same advantage as the first embodiment.

Further, according to the second embodiment, the abnormal causes are identified based on the tank internal pressure integration value ΣP that has been obtained before starting the abnormal state diagnosis. However, the tank internal pressure integration value ΣP may be calculated after detecting the abnormal state of the evaporation gas purge system line to identify the abnormal causes.

Furthermore, to identify the respective abnormal causes such as the locking of the purge control valve 26 in the valve closing state, the locking of the atmosphere change over valve 24 in the valve opening state and the large amount leakage, the two thresholds K4 and K5 are used to compare with the tank internal pressure integration value ΣP. However, three or more threshold values may be used to compare with the tank internal pressure integration value ΣP to identify the abnormal causes.

Moreover, the diagnosis apparatus may detect and identify only two abnormal causes among the locking of the purge control valve 26 in the valve closing state, the locking of the atmosphere change over valve 24 in the valve opening state and the large amount leakage (for example, the locking of the purge control valve 26 in the valve closing state and the locking of the atmosphere change over valve 24 in the valve opening state).

Third Embodiment

According to a third embodiment, a diagnosis program for detecting the abnormal state of the evaporation gas purge system line shown in FIG. 8 is executed every a given time (for example, 100 msec). Each Step of this program, which executes the same process as the program of the first embodiment shown in FIG. 2, has the same reference number as the first embodiment and the explanation thereof is omitted.

According to the program of the third embodiment, when the purge control valve 26 is opened to start the negative pressure introduction, a tank internal pressure P0 at a starting time of the negative pressure introduction is memorized at Steps 104*a* and 104*b*. Then, when the tank internal pressure P does not decrease up to the given negative pressure even if the longest time for introducing the negative pressure has lapsed after the negative pressure introduction starts, it is determined that the evaporation gas purge system line is in an abnormal state and the process goes to Step 106*b*. At Step 106*b*, an increase amount (P–P0) of the tank internal pressure P during the negative pressure introduction period is compared with a threshold K6 (for example K6=0 or near 0). If the increase amount (P–P0) is larger than the threshold K6, it is presumed that the tank internal pressure P has increased during the negative pressure introduction period and the process goes to Step 108*b* where determines that the purge control valve 26 is locked in a valve closing state. That is, a fact that the tank internal pressure P increases during the negative pressure introduction time period represents that the negative pressure is not introduced at all to the fuel tank 18, which means the locking of the purge control valve 26 in the valve closing state.

Unless the increase amount (P–P0) is larger than the threshold K6, the process goes to Step 19*b* which determines that the atmosphere change over valve 24 is locked in the valve opening state or that the large amount leakage occurs. In this case, even if the tank internal pressure P does not decrease up to the given negative pressure and unless the increase amount (P–P0) is larger than the threshold K6, it can be determined that the atmosphere change over valve 24 is locked in the valve opening state or that the large amount leakage occurs since it is presumed that the negative pressure is introduced more or less to the evaporation gas purge system line.

According to the third embodiment mentioned above, when the abnormal state of the evaporation gas purge system line is detected, it is determined which the abnormal cause is, the locking of the purge control valve 26 in the valve closing state or the locking of the atmosphere change over valve in the valve opening state (or the large amount leakage).

What is claimed is:

1. A diagnosis apparatus for detecting an abnormal state of an evaporation gas purge system line having a passage connecting between a fuel tank and an intake pipe for an internal combustion engine, a canister disposed in the passage for adsorbing evaporation fuel gas from the fuel tank, a purge control valve for controlling a purge of the evaporation fuel gas from the canister to the intake pipe and an atmosphere change over valve for opening and closing an atmosphere communication hole of the canister, the abnormal state of the evaporation gas purge system line being due to at least one of abnormal causes among a valve closing lock of the purge control valve, a valve opening lock of the atmosphere change over valve and a large amount leakage that the evaporation fuel gas leaks to atmosphere from a portion other than the atmosphere communication hole, comprising:

pressure detecting means for detecting a tank internal pressure of the fuel tank;

abnormal state detecting means for judging an existence of the abnormal state by detecting a fact that, when the purge control valve is opened to introduce a negative pressure from the intake pipe to the fuel tank via the passage in a state that the atmosphere change over valve is closed, the tank internal pressure detected by the pressure detecting means does not decrease up to a given negative pressure at a time when a given time has lapsed after opening the purge control valve; and abnormal cause determining means for identifying the at least one of abnormal causes based on the tank internal pressure detected by the pressure detecting means when the existence of the abnormal state thereof is judged by the abnormal state detecting means;

wherein the abnormal cause determining means has one of two calculation means, one calculation means calculating a change amount of the tank internal pressure during a given period and the other calculation means calculating an integration value of the tank internal pressure during another given period, and comparing means for comparing one of the change amount and the integration value with at least one of threshold values so that the at least one of the abnormal causes is identified.

2. A diagnosis apparatus according to claim 1, wherein the one of the change amount and the integration value is calculated when the internal combustion engine is operated in a driving range in which the purge control valve is intermittently opened to intermittently purge the evaporation fuel gas from the canister to the intake pipe in a state that the atmosphere change over valve is opened.

3. A diagnosis apparatus according to claim 1, wherein the comparing means determines the abnormal cause as the valve closing state locking of the purge control valve when one of two conditions is satisfied, the one condition being that the change amount is not larger than a first given value representing the at least one of threshold values and the other condition being that the integration value is not smaller than a second given value representing the at least one of threshold values.

4. A diagnosis apparatus according to claim 3, wherein the comparing means determines the valve opening state locking of the atmosphere change over valve when one of two conditions is satisfied, the one condition being that the change amount is larger than a third given value among the threshold values, which is larger than the first given value, and the other condition being that the integration value is smaller than a fourth given value among the threshold values, which is smaller than the second given value.

5. A diagnosis apparatus according to claim 4, wherein the comparing means determines the large amount leakage when one of two conditions is satisfied, the one condition being that the change amount is larger than the first given value but is not larger than the third given value and the other condition being that the integration value is not smaller than the fourth given value but smaller than the second given value.

6. A method of detecting an abnormal state of an evaporation gas purge system line having a passage connecting between a fuel tank and an intake pipe for an internal combustion engine, a canister disposed in the passage for adsorbing evaporation fuel gas from the fuel tank, a purge control valve for controlling a purge of the evaporation fuel gas from the canister to the intake pipe and an atmosphere change over valve for opening and closing an atmosphere communication hole of the canister, the abnormal state of the evaporation gas purge system line being due to at least one of abnormal causes among a valve closing lock of the purge control valve, a valve opening lock of the atmosphere change over valve and a large amount leakage that the evaporation fuel gas leaks to atmosphere from a portion other than the atmosphere communication hole, the method comprising:

detecting a tank internal pressure of the fuel tank;

judging an existence of the abnormal state by detecting a fact that, when the purge control valve is opened to introduce a negative pressure from the intake pipe to the fuel tank via the passage in a state that the atmosphere change over valve is closed, the detected tank internal pressure does not decrease up to a given negative pressure at a time when a given time has lapsed after opening the purge control valve; and identifying the at least one of abnormal causes based on the tank internal pressure detected when the existence of the abnormal state thereof is judged;

wherein the abnormal cause is identified through one of two calculations, one calculation including calculating a change amount of the tank internal pressure during a given period and the other calculation including calculating an integration value of the tank internal pressure during another given period, and comparing one of the change amount and the integration value with at least one of threshold values so that the at least one of the abnormal causes is identified.

7. A method according to claim 6, wherein the one of the change amount and the integration value is calculated when the internal combustion engine is operated in a driving range in which the purge control valve is intermittently opened to intermittently purge the evaporation fuel gas from the canister to the intake pipe in a state that the atmosphere change over valve is opened.

8. A method according to claim 6, wherein the abnormal cause as the valve closing state locking of the purge control valve is determined when one of two conditions is satisfied, the one condition being that the change amount is not larger than a first given value representing the at least one of threshold values and the other condition being that the integration value is not smaller than a second given value representing the at least one of threshold values.

9. A method according to claim 8, wherein the valve opening state locking of the atmosphere change over valve is determined when one of two conditions is satisfied, the one condition being that the change amount is larger than a third given value among the threshold values, which is larger than the first given value, and the other condition being that the integration value is smaller than a fourth given value among the threshold values, which is smaller than the second given value.

10. A method according to claim 9, wherein the large amount leakage is determined when one of two conditions is satisfied, the one condition being that the change amount is larger than the first given value but is not larger than the third given value and the other condition being that the integration value is not smaller than the fourth given value but smaller than the second given value.

* * * * *